US005178684A

United States Patent [19]

Hutchins, Sr.

[11] Patent Number: 5,178,684

[45] Date of Patent: Jan. 12, 1993

[54] METHOD FOR CLEANING WATER PIPE

[76] Inventor: Danny T. Hutchins, Sr., 1065 Great Oaks, Rochester, Mich. 48307

[21] Appl. No.: 711,165

[22] Filed: Jun. 5, 1991

[51] Int. Cl.[5] ..... B08B 9/00; B08B 9/02

[52] U.S. Cl. ..... 134/22.11; 134/22.12; 134/18; 134/126 C; 134/167 C; 134/168 C; 134/169 C; 137/14; 137/15; 137/43; 137/239

[58] Field of Search ..... 134/22.11, 22.12, 18, 134/166 C, 167 C, 168 C, 169 C; 137/15, 14, 43, 239

[56] References Cited

U.S. PATENT DOCUMENTS

| | | | |
|---|---|---|---|
| 603,465 | 5/1898 | Dredge et al. | 137/239 |
| 695,323 | 3/1902 | Mittinger | 134/22 |
| 821,087 | 5/1906 | Charvat | 15/104.07 |
| 1,363,301 | 12/1920 | Zilliox | 15/104.07 |
| 2,147,593 | 2/1939 | Bracken | 15/104.07 |
| 2,371,188 | 3/1945 | Russell | 137/239 |
| 2,877,781 | 3/1959 | Lipp et al. | 134/166 R |
| 3,089,792 | 5/1963 | Skardal | 134/21 |
| 3,432,383 | 3/1969 | Russell | 162/272 |
| 3,457,108 | 7/1969 | Hittel | 134/22.18 |
| 3,593,920 | 7/1971 | Watson | 239/119 |
| 3,823,427 | 7/1974 | Pittet | 134/24 |
| 3,825,443 | 7/1974 | Reilly | 134/24 |
| 3,969,255 | 7/1976 | Connelly, Jr. | 134/42 |
| 4,167,209 | 9/1979 | Simpson | 134/1 |
| 4,216,026 | 8/1980 | Scott | 134/4 |
| 4,559,085 | 12/1985 | Liu et al. | 134/22.11 |
| 4,563,781 | 1/1986 | James | 134/22.12 |
| 4,857,112 | 8/1989 | Franninge | 134/22.12 |

FOREIGN PATENT DOCUMENTS

| | | | |
|---|---|---|---|
| 0597443 | 3/1978 | U.S.S.R. | 134/22.12 |

*Primary Examiner*—Theodore Morris
*Assistant Examiner*—Zeinab El-Arini
*Attorney, Agent, or Firm*—Dykema Gossett

[57] ABSTRACT

A method and an apparatus are disclosed for cleaning water pipe. The pipe is preferably connected to a source of water which normally flows through the pipe to an outlet. A valve is positioned at the outlet and is rapidly opened and closed. When the valve is closed a pressure pulse is created in the pipe and travels towards the source of fluid. This wave is reflected back from the source towards the outlet. The alternate waves expand and contract the pipe wall, and cause pressure fluctuations within the pipe. The combined action removes scale from the wall of the pipe, and when the valve is opened the removed scale passes out of the pipe.

16 Claims, 3 Drawing Sheets

FIG.2
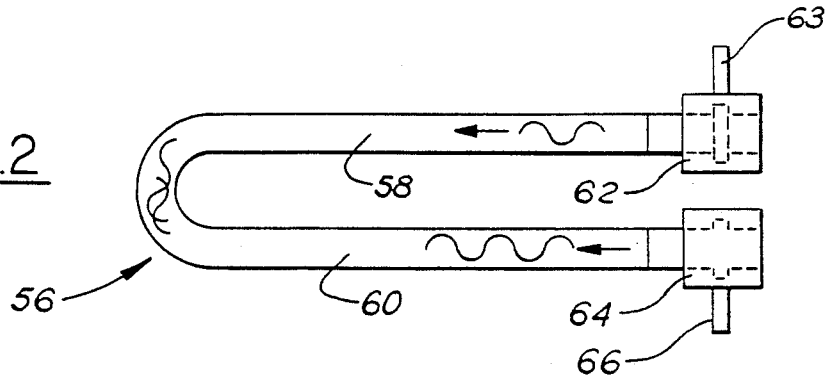
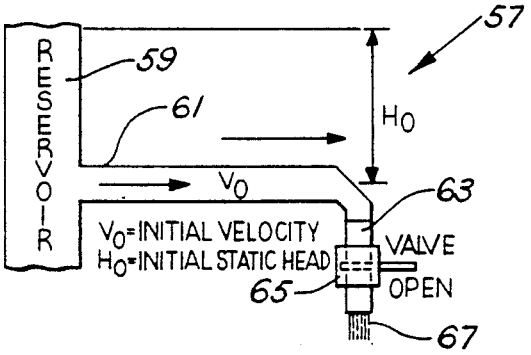
FIG.3
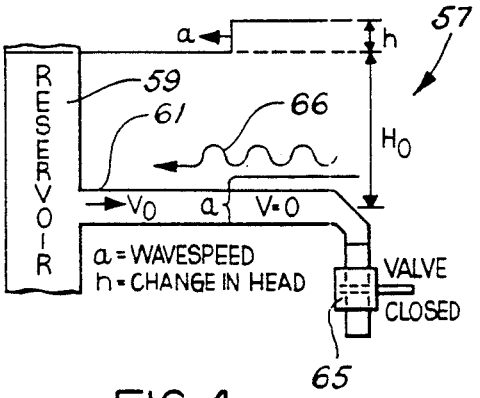
FIG.4
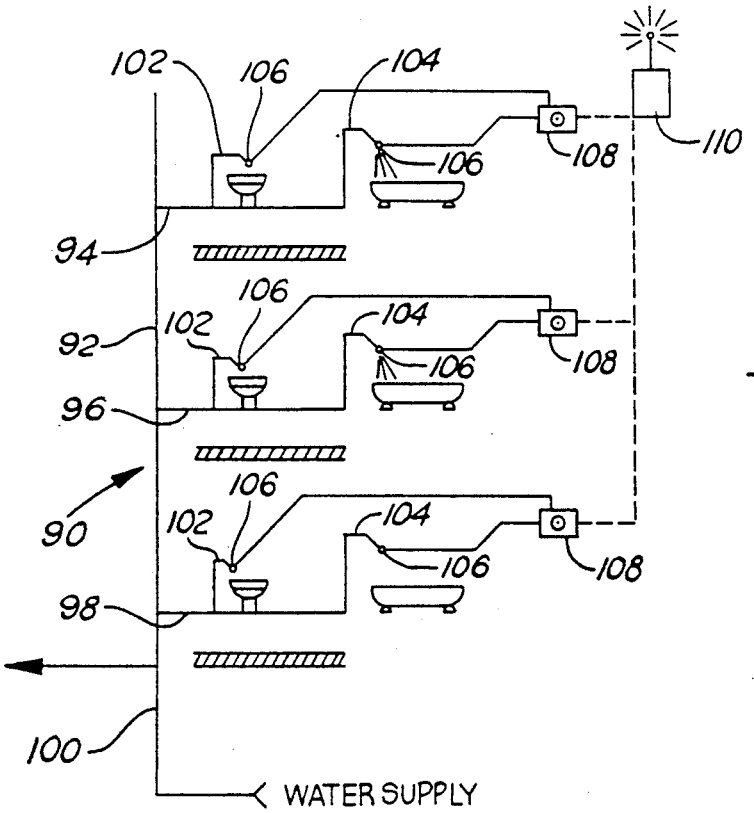
FIG.11

SYSTEM CONDITIONS AT L/a SECONDS

SYSTEM CONDITIONS BETWEEN L/a AND 2L/a SECONDS

SYSTEM CONDITION AT 2L/a SECONDS

SYSTEM CONDITION BETWEEN 2L/a AND 3L/a SECONDS

SYSTEM CONDITION BETWEEN 3L/a SECONDS AND 4L/a SECONDS

PRESSURE VERSUS TIME US VALUE-WAVE FRONT

METHOD FOR CLEANING WATER PIPE

BACKGROUND OF THE INVENTION

This application in general relates to a method and apparatus for efficiently removing scale and other deposits from the interior surface of a pipe.

Various methods of cleaning pipes are known in the prior art. In general, these methods involve the attachment of complex systems to the pipe, and such methods have not always proven effective. It would be desirable to develop a system which can effectively and simply remove deposits from the interior of pipes, and in particular water pipes.

Scale deposits on water carrying pipes can build up to the point that the scale completely blocks water flow through the pipe. Calcium carbonate and magnesium, which are naturally present in all water supplies, can form a precipitate of calcium, magnesium, iron, as well as other minerals that collects on pipe walls. This forms hard calcium carbonate scale which ultimately reduces, and eventually stops, water flow through the pipe. This problem is particularly acute when high water temperatures of above 130° Fahrenheit are encountered. In heat exchanger tubes this scale not only reduces the amount of flow through the tubes, but can also reduce the heat exchange efficiency of the tube walls.

Therefore, it is an object of the present invention to disclose a method and apparatus for quickly and efficiently cleaning pipe interior walls.

SUMMARY OF THE INVENTION

In a disclosed embodiment of the present invention, a valve is disposed downstream of an outlet pipe in a water supply system. The outlet communicates with a source of water and the valve is rapidly opened and closed to alternately block, and then allow water flow from the outlet. When the valve is closed, a pressure wave is directed upstream towards the source of the water. That wave reflects back towards the outlet while the valve remains closed. The alternating pressure waves moving between the source of water and the outlet remove scale from the pipe walls, and also expand the pipe walls, further loosening scale. When the valve is eventually opened, the flow of water out of the outlet removes the loose scale and deposits from the pipe. The valve is rapidly opened and closed until the water leaving the outlet is clear and free of removed deposits.

In one embodiment of the present invention the valve is manually opened and closed. In an alternative embodiment, the valve is electrically controlled.

The valve is preferably a rotary-type valve which is moved between opened and closed position through a limited circumferential extent. A valve member includes a lever which is moved manually, or by a solenoid member in the electrically controlled embodiment, to move the valve member between positions where it blocks a port and closes flow through the valve and an opened position where it opens the port and allows flow through the valve. The rotary valve has particular advantages in the disclosed embodiment since it is not being moved into the pressurized fluid, but rather is cutting across the fluid to move between the opened and closed positions.

In preferred embodiments of the present invention, several outlets on a single riser or supply line are connected to valves which are opened and closed in timed sequence to control the pressure waves through the several lines. A radio controlled valve can open and close several of the valves in timed sequence to control the pressure waves and to clean an entire system.

These and other objects and features of the present invention can be best understood from the following specifications and drawings, of which the following is a brief description.

BRIEF DESCRIPTION OF THE DRAWINGS

FIG. 2 is a largely schematic view of the cleaning of a heat exchanger tube.

FIG. 3 shows a largely schematic analysis of the forces involved initially in cleaning a pipe with the inventive method.

FIG. 4 shows a step subsequent to that shown in FIG. 3.

FIG. 11 is a largely schematic view of the connection of the inventive system to an entire water supply system.

DETAILED DESCRIPTION OF THE PREFERRED EMBODIMENT

Figure 1A:
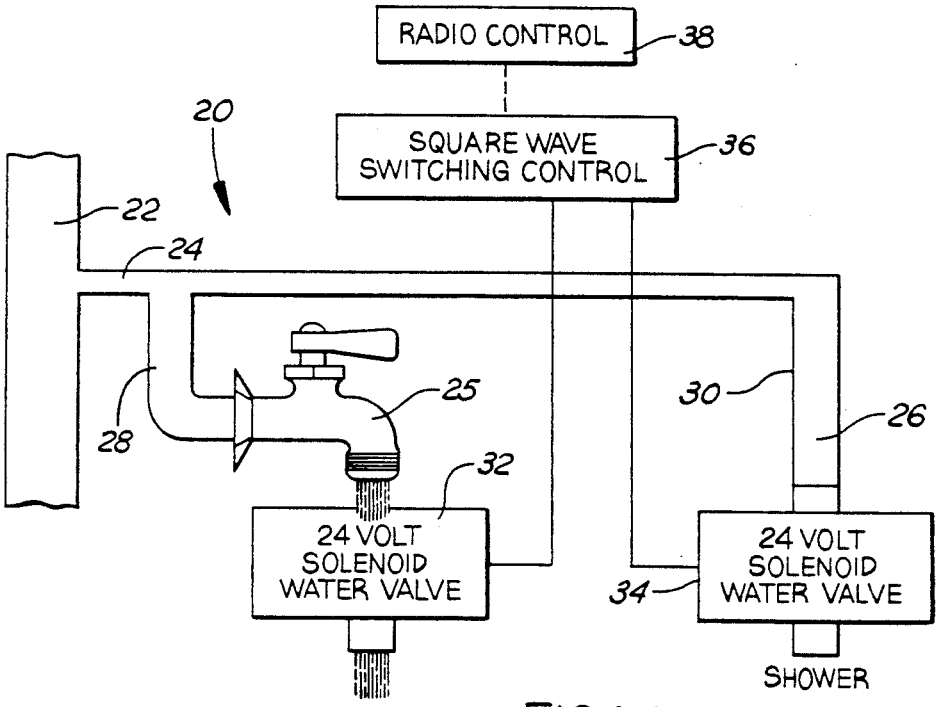
FIG. 1A is a largely schematic view of the connection of the disclosed cleaning system to a standard water supply system.

System 20 for cleaning a plurality of outlets receiving water from a riser or supply 22 is illustrated in FIG. 1A. Riser 22 communicates with supply line 24, leading to faucet 25 and shower head 26. Faucet 25 and shower head 26 are shown somewhat schematically, and it should be understood that a number of additional outlets could be included on line 24. Pipe 28 connects line 24 and faucet 25 while pipe 30 connects line 24 and shower head 26. Valve 32 is mounted on faucet while a similar valve 34 is mounted on shower head 36.

A square wave switching control 36 may communicate with valves 32 and 34 to actuate solenoids to move valves 32 and 34 between open and closed positions. When valves 32 and 34 are open, they allow flow out of faucet 25 and shower head 26, respectively, and while they are closed they block the flow and create pressure waves directed back into pipes 28, 30 and 24 to remove deposits from the interior pipe walls. This process will be briefly explained with reference to FIGS. 1B–1D.

Figure 1B:
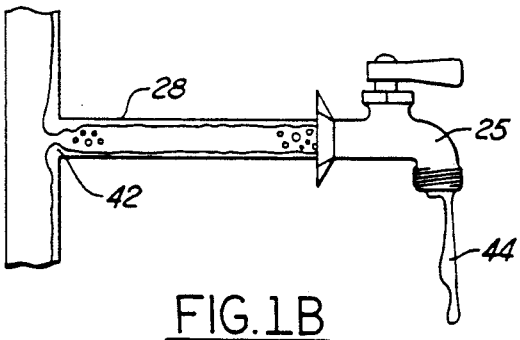
FIG. 1B is a cross-sectional view through a water supply pipe encrusted with scale.

As shown in FIG. 1B, pipe 28 is encrusted with scale 42. The amount of scale 42 within pipe 28 reduces the outlet volume of water 44 from faucet 25.

Figure 1C:
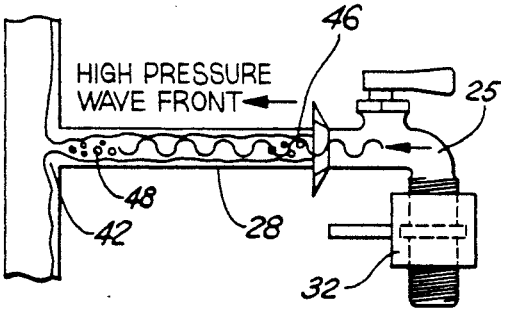
FIG. 1C is a view of the pipe shown in FIG. 1B being cleaned by the inventive method.

Valve 32 is mounted on faucet 25 in FIG. 1C. Valve 32 preferably has screw threads received in mating threads on faucet 25. Valve 32 is closed, and pressure wave 46 is directed upstream towards pipe 24. Pressure wave 46 expands the wall of pipe 28 loosening scale 42, and also pressurizes the water within the pipe removing further scale, such as shown at 48, from pipe 28.

Figure 1D:
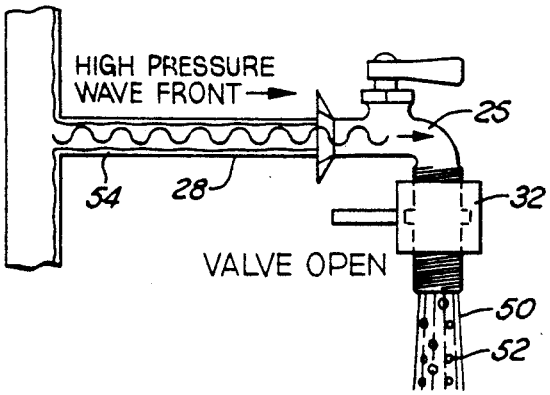
FIG. 1D shows a subsequent step in the cleaning of the pipe illustrated in FIG. 1C.

As shown in FIG. 1D, when valve 32 is opened, water jets outwardly from valve 32 as shown at 50. Jet 50 includes entrained scale 52 which has been removed from the wall of pipe 28. As shown at 54, scale deposits within pipe 28 are greatly reduced by the inventive method.

FIG. 2 shows a system for cleaning heat exchange tube 56 by the inventive method. Tube 56 has first leg 58 and second leg 60. Leg 58 receives valve 62, which is opened and closed by lever 63, while leg 60 receives valve 64 which is opened and closed by lever 66. Solenoids may move levers 63 and 66 between open and closed positions. Valves 62 and 64 could be said to be opened and closed by movement of a valve element between a limited circumferential extent. When closed, the valve element blocks ports in the valve, when opened water flows through the ports.

In the system shown in FIG. 2, a supply of water is connected to one of valves 62 and 64, and the other becomes an outlet. Valves 62 and 64 are rapidly opened and closed, preferably 45 degrees out of phase, such that pressure pulses move in alternate directions between legs 60 and 58 to remove scale. In one embodiment of the method of cleaning a heat exchange tube, valve 64 is initially closed and valve 62 is opened. Fluid may move into pipe 58 and pipe 60. Valve 64 is then closed and valves 62 and 64 are then opened and closed 45 degrees out of phase.

FIGS. 3 through 10 illustrate the basic physical conditions within a pipe as the method of the present invention is being performed. A simple one pipe system 57 is illustrated in FIG. 3 having reservoir 59 supplying fluid to pipe 61, and communicating with outlet 67. Valve 65 is mounted on outlet 67, and directs fluid outwardly of the pipe 61. At the time illustrated in FIG. 3, valve 65 is open and fluid is moving with an initial velocity $V_O$ and initial static head $H_O$ driving the flow.

As shown in FIG. 4, valve 65 has been closed. A pressure wave 66 is created from the fluid traveling down pipe 61 which no longer has an outlet, and is directed upstream towards reservoir 59. Because the flowing liquid has both mass and velocity, it cannot be stopped instantaneously when valve 65 is closed. The water in the pipe must go somewhere. A small but measurable additional mass of water becomes stored in the pipe and causes the pipe walls to expand. The remainder of the mass compresses the liquid. Water is not generally considered compressible, however it does have some elasticity. Storage of the additional water in pipe 61 causes a small local rise in pressure adjacent valve 65 of a magnitude h.

Thus, when valve 65 initially closes two events occur. There is an immediate stoppage of outlet flow through outlet 67 and a sharp local rise in pressure over a very short period of time adjacent to valve 65 to a pressure of $H_O+h$. Once valve 65 is initially closed an unstable condition exists within pipe 61. In an area immediately in front of valve 65, flow has stopped and pressure is relatively high compared to the remainder of pipe 61. The distance traveled by wave 66 defines the amount of pipe 61 which would include the area of water having a zero velocity and higher pressure, $H_O+h$. A wave speed defines how quickly wave 66 moves towards reservoir 59, changing the pressure and velocity along pipe 61 as it moves, and loosening and removing scale.

The time required for wave 66 to reach reservoir 59 is proportional to the length of the pipe L and wave speed a. This time is defined as L/a. During this time, flow and pressure are still at their initial values upstream, closer to reservoir 59. Wave 66 travels towards reservoir 59 at a very high speed causing a disturbance or wave front. Wave 66 moves approximately at the speed of sound in this water medium and creates a moving pressure gradient that is just large enough to stop the flow of water moving towards outlet 67.

Figure 5:
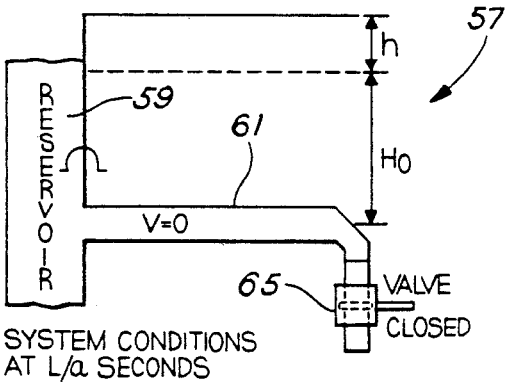
FIG. 5 shows a step subsequent to that shown in FIG. 4.

FIG. 5 shows system 57 once the wave has reached reservoir 59. At that time the pressure is uniformly $H_O+h$ throughout pipe 61 and there is no fluid flow. This situation is unstable because the pressure in pipe 61 is higher than the reservoir pressure $H_O$. The higher pressure in pipe 61 causes fluid to be forced into reservoir 59 at a flow rate equal and opposite to the original flow. This creates a reduction in pressure in pipe 61 until it reaches the pressure level in reservoir 59.

Figure 6:
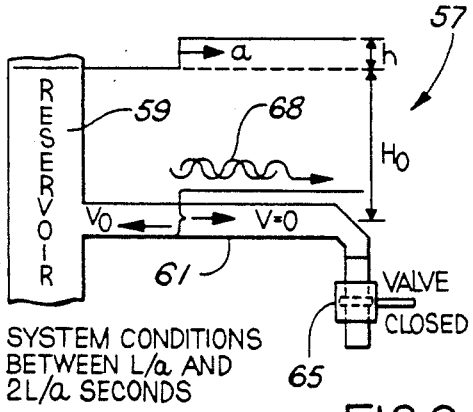
FIG. 6 shows a step subsequent to that shown in FIG. 5.

A disturbance is then created from reservoir 59 towards valve 65. As illustrated in FIG. 6, wave 68 travels back towards valve 65. Upstream of wave front 68, flow towards the reservoir is reestablished at $V_O$ and the pressure is at reservoir pressure $H_O$. Downstream of wave front 68, there is still no flow and the pressure is still elevated by a magnitude of h.

Figure 7:
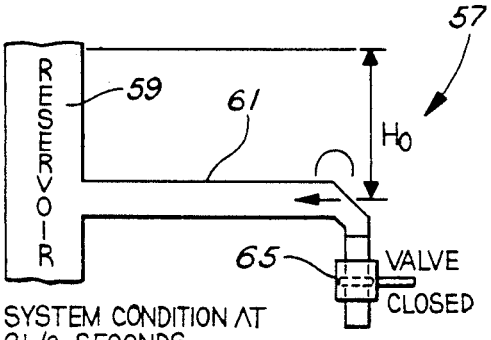
FIG. 7 shows a step subsequent to that shown in FIG. 6.

Once wave front 68 reaches valve 65, the situation is as shown in FIG. 7. Flow throughout pipe 61 is again stopped and the pressure throughout the system is again at reservoir pressure $H_O$.

Figure 8:
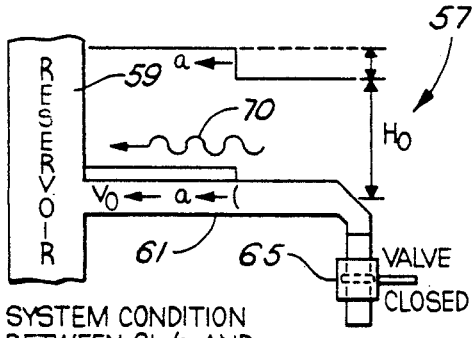
FIG. 8 shows a step subsequent to that shown in FIG. 7.

As shown in FIG. 8, valve 65 will still stop flow from outlet 67. There is a sudden pressure drop at valve 65 as the moving fluid tries to pull away from valve 65. This starts a return wave 70 upstream towards reservoir 59. There is now a reduction in pressure of a magnitude h below $H_O$ which travels towards reservoir 59. The reduced pressure may contract pipe 61.

Figure 9:
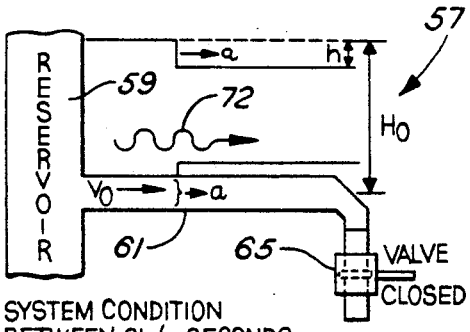
FIG. 9 shows a step subsequent to that shown in FIG. 8.

As shown in FIG. 9, when the wave illustrated in FIG. 8 reaches reservoir 59, an unbalanced condition is again created in pipe 61. The depressed pressure level in pipe 61 creates a flow from reservoir 59 back into pipe 61. This disturbance creates a wave 72 which travels downstream towards closed valve 65. When wave 72 reaches valve 65, pipe 61 is temporarily restored to its original condition as shown in FIG. 3.

If the valve remained closed and no friction existed, the process steps in FIGS. 3-9 would continue indefinitely, repeating itself every 4L/a seconds. In a real life situation, energy loss caused by friction, viscous losses and other losses dampen the process, eventually bringing the wave action to rest.

The continued expansion and contraction of pipe 61 caused by sharp rises and drops in pressure, combined with the back-and-forth saw tooth action of the waves breaks scale off of the walls of pipe 61 and allows the waves to sweep away loose scale which might otherwise collected in elbows, t's or bends in the pipes. The scale debris is pushed outwardly by the reflecting water waves and through valve 65 when the valve is eventually opened.

Figure 10:
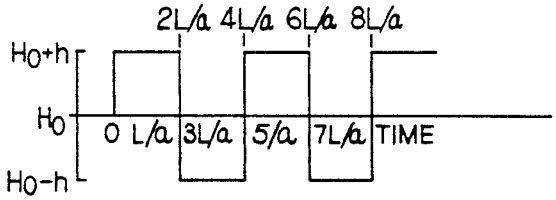
FIG. 10 is a graph of the pressures at a valve during the steps illustrated in FIGS. 3 through 9.

FIG. 10 shows a graph of pressure at valve 65 over time. The pressure at the valve increases rapidly from $H_O$ to $H_O+h$ and remains there until 2L/a seconds. At that time it drops to $H_O - h$ and remains there until 4L/a seconds. If the valve is not opened, this cycle would theoretically repeat itself indefinitely. In practice, the magnitude of the waves is reduced over time due to various losses, and is eventually dampened towards the pressure $H_O$.

When the method of the present invention is applied to clean a liquid distribution system or heat exchanger, the whole system, including mains, risers, branch lines and the exchanger is effectively a reservoir. When one is cleaning a water distribution riser that has multiple outlets, flush valves may be mounted on each of the outlets and opened and closed 45° to 180° apart, creating wave fronts that are out of phase within the water supply lines.

When using the process of the present invention to clean scale and corrosion particles from a pipe, the valve would be preferably opened and closed very rapidly. Cycling times on the order of 40 pulses per minute are preferred. It is preferred that the valve is kept closed at least for 4L/a seconds on each cycle. The wave speed is related to the compressibility of the fluid and the elasticity of the pipe wall. Equations are known to determine the wave speed a as described in this application.

An application of this invention to a system 90 is illustrated in FIG. 11. System 90 includes riser 92 delivering water to a plurality of outlet lines 94, 96, 98 from water supply main 100. Each outlet line 94, 96, 98 includes outlets such as faucet 102, and shower head 104. Outlets 102 and 104 each receive valves 106, with the valves 106 received on respective outlets 102 and 104 being connected to a single square wave switching control 108. Valves 106 are preferably solenoid controlled, as described above. The square wave switching controls 108 connecting to each of the outlet lines 94, 96 and 98 all communicate with a single radio control 110. Radio control 110 allows a single operator to open and close valves 106 at the multiple locations. The square wave switching control 108 allows the time the valves 106 are open to be varied. Also, the switching controls 108 allow the time that each of the respective valves 106 is open to be varied relative to the other valves. The square wave switching control could have a power adjustment of 12, 24, 36 or 48 DC volts.

Further, the use of a system 90 such as illustrated in FIG. 11 allows operation of two or more of the valves 106 out of phase in a synchronized manner. This allows a pipe of long length with multiple outlets to be thoroughly cleaned. Further, wave fronts of uniform lengths and heights may be created and generated out of phase from each other.

A preferred embodiment of the present invention has been disclosed, however, a worker of ordinary skill in the art would recognize that certain modifications would come within the scope of this invention. For that reason, the following claims should be studied in order to determine the true scope and content of this invention.

I claim:

1. A method of cleaning a pipe comprising the steps of:

(1) communicating a source of liquid to the pipe, and flowing the liquid through the pipe towards an outlet;

(2) positioning a valve at the outlet; and (3) rapidly closing and opening the valve at a rate of several times a minute to alternately block and allow flow of fluid from the pipe out of the outlet, blocked the fluid with the closed valve creating pressure waves within the pipe, removing scale from the interior of the pipe walls.

2. The method as recited in claim 1, wherein the valve is opened and closed electronically.

3. The method as recited in claim 2, wherein there are plural outlets communicating with the same source of liquid, and there are valves mounted on each of the plural outlets which are opened and closed out of phase from the others.

4. The method as recited in claim 3, wherein a single switching control controls the rapid opening and closing of the plural valves.

5. The method as recited in claim 3, wherein the valves on the plural lines are controlled by a single radio control.

6. The method as recited in claim 1, wherein the pipe is a heat exchange tube, with one end of the tube being connected to a source of fluid and the other end being defined as the outlet, valves being mounted on each end and each being rapidly opened and closed.

7. The method as recited in claim 1, wherein the pipe is connected to a standard water outlet in a water supply system.

8. The method as recited in claim 7, wherein the outlet is a sink faucet.

9. The method as recited in claim 7, wherein the outlet is a shower head.

10. The method as recited in claim 1, wherein the valve is moved through a limited circumferential extent between opened and closed positions.

11. The method as recited in claim 10, wherein a solenoid is actuated to move a lever associated with the valve member to move it between the opened and closed position.

12. A method of cleaning a pipe comprising the steps of:

(1) communicating a source of fluid flow to a pipe, inlet and flowing the fluid from the source through the pipe inlet to an outlet;

(2) mounting a rotary valve which is movable between a limited circumferential extent between opened and closed positions on the outlet; and (3) controlling the opening and closing of the rotary valve to achieve a desired cycling frequency of valve opening and closing times, the cycling frequency being greater than one cycle per minute.

13. The method as recited in claim 12, wherein the rotary valve is opened and closed electronically.

14. The method as recited in claim 12, wherein there are a plurality of such pipes and rotary valves, and a single switching control actuates at least two of said valves.

15. The method as recited in claim 14, wherein a solenoid drives a lever member to move the rotary valve between the opened and closed positions.

16. The method as recited in claim 12, wherein the pipe is a heat exchange tube.

* * * * *